US010036573B2

(12) United States Patent
Huang et al.

(10) Patent No.: US 10,036,573 B2
(45) Date of Patent: Jul. 31, 2018

(54) HOT WATER SUPPLY SYSTEM

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Yunlin (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 735 days.

(21) Appl. No.: 14/260,482

(22) Filed: Apr. 24, 2014

(65) Prior Publication Data

US 2015/0114313 A1 Apr. 30, 2015

(30) Foreign Application Priority Data

Oct. 30, 2013 (TW) ..... 102139337 A

(51) Int. Cl.
*F24H 9/20* (2006.01)
*F24H 1/12* (2006.01)
(Continued)

(52) U.S. Cl.
CPC ..... *F24H 9/2035* (2013.01); *F24D 17/0026* (2013.01); *F24D 19/1051* (2013.01);
(Continued)

(58) Field of Classification Search
CPC ..... B60H 1/02; B60H 1/04; B60H 1/00314; B60H 2001/00307; F23L 11/005; F23M 2900/11021; F23N 5/24; F24H 9/2035; F24H 9/20; F24H 9/2007; F24H 9/12; F24H 9/122; F22D 7/00; F22D 7/04
(Continued)

(56) References Cited

U.S. PATENT DOCUMENTS 6,729,390 B1 * 5/2004 Toth ..... F24D 12/02 165/240
8,271,143 B2 * 9/2012 Deivasigamani ... F24D 17/0026 122/1 C
(Continued)

*Primary Examiner* — Helena Kosanovic
*Assistant Examiner* — Ko-Wei Lin
(74) *Attorney, Agent, or Firm* — Tracy Heims; Apex Juris, pllc.

(57) ABSTRACT

A hot water supply system provided on a water pipeline, which includes a water inflow side and a water outlet side. The hot water supply system includes a plurality of water heaters; each includes a conduit, a heating device, a calculating unit, and a control unit. The conduit includes an inlet section, an outlet section, and a heating section in sequence, wherein the inlet section and the outlet section are connected with the water inflow side and the water outflow side respectively; the heating device heats the heating section; the calculating unit estimates a heating workload needed. If the heating workload of any water heater exceeds a predetermined upper limit workload thereof, the control unit of one water heater controls the other idle heating device to heat water, which ensures that water temperature of water provided to the water outflow side would reach a demanded water temperature.

12 Claims, 3 Drawing Sheets

(51) Int. Cl.
*F24H 1/14* (2006.01)
*F24D 17/00* (2006.01)
*F24D 19/10* (2006.01)

(52) U.S. Cl.
CPC ..... *F24H 1/124* (2013.01); *F24H 1/145* (2013.01); *F24D 2200/043* (2013.01)

(58) Field of Classification Search
USPC ..... 122/14.1, 14.2, 14.3; 237/8 R, 8 A
See application file for complete search history.

(56) References Cited

U.S. PATENT DOCUMENTS

2012/0138149 A1* 6/2012 Hatada ..... F24H 1/10
137/1
2013/0126627 A1* 5/2013 Paine ..... F24H 9/2035
237/8 B

* cited by examiner

HOT WATER SUPPLY SYSTEM

The current application claims a foreign priority to the patent application of Taiwan No. 102139337 filed on Oct. 30, 2013.

BACKGROUND OF THE INVENTION

1. Technical Field

The present invention relates generally to a water heater, and more particular to a hot water supply system which includes several water heaters.

2. Description of Related Art

Hot water supply systems are installed at places with high water consumption, such as hospitals or hotels, to provide large amounts of hot water. As shown in FIG. 1, a conventional hot water supply system 100 includes a plurality of water heaters 10 and a main control device 12, wherein each water heater 10 has a conduit, which has an inlet section 102 and an outlet section 104, a gas conduit 106, and a control unit 108. The inlet section 102 of each conduit is connected with a water pipe W for water to flow into each water heater 10, the outlet section 104 of each conduit is connected with a plurality of faucets F, and the gas conduits 106 are all connected with a gas pipe G. Each control unit 108 controls each water heater 10 to heat water. The main control device 12 is electrically connected to each control unit 108 to coordinate the operation of each water heater 10, and it has a setting unit 122 for setting a demanded water temperature of water flowing to the faucets F. The hot water supply system 100 could provide hot water with the demanded temperature when any faucets F are turned on.

However, if the main control device 12 malfunctions, the hot water supply system 100 would stop providing water until the main control device 12 gets replaced, which is quite inconvenient. In addition, the main control device 12 of the hot water supply system 100 is stand-alone, and therefore occupies some additional space. With more water heaters 10 being connected, the main control device 12 gets more wiring, thus the installation becomes more complicated. In other words, if the main control device 12 can be omitted, the complexity of installation, the space occupied, and the cost of manufacturing would be reduced. Therefore, the design of the conventional hot water supply system 100 needs to be improved.

BRIEF SUMMARY OF THE INVENTION

In view of the above, the primary objective of the present invention is to provide a hot water supply system, which makes the hot water supply system operational again even when the coordinating mechanism for water heaters loses efficacy.

The secondary objective of the present invention is to provide a hot water supply system, which could reduce the complexity of installation and the cost of manufacturing.

Yet another objective of the present invention is to provide a hot water supply system, which could reduce the space occupied.

The present invention provides a hot water supply system connected to a water pipeline, which includes a water inflow side and a water outlet side. The hot water supply system includes a plurality of water heaters, and each water heater includes a conduit, a heating device, a detecting module, a calculating unit, and a control unit. The conduit includes an inlet section, a heating section, and an outlet section in sequence; the inlet section and the outlet section are connected with the water inflow side and the water outflow side of the water pipeline respectively, and the heating section is in association with the heating device; the detecting module detects an operation status of the water heater, and the operation status includes a water temperature inside the inlet section, a water temperature inside the outlet section, and a water flow inside the inlet section; the calculating unit is electrically connected to the detecting module, and the calculating unit estimates a heating workload of the heating device according to the operation status, and the heating workload is thermal energy needed to heat cold water to a demanded water temperature within a specific period of time; the heating device is controllable to heat up the heating section, and the heating device has a predetermined upper limit workload, which is thermal energy the heating device is allowed to provide within the specific period of time; the control unit controls the heating device to heat water, and is electrically connected to the control units of other water heaters.

When the heating workload of the heating device of any water heaters exceeds its predetermined upper limit workload, the control unit of the water heater contacts the control unit of another water heater to control its heating device to heat water, which makes water temperature of water provided to the water outflow side of the water pipeline reach the demanded water temperature.

With such design, one of the water heaters is in charge to coordinate all water heaters, and if this water heater malfunctions, one of other water heaters could take on its job, so that the hot water supply system could be operational again. Furthermore, the wiring is simplified, the cost of manufacturing is lowered, and the space occupied is reduced as well.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
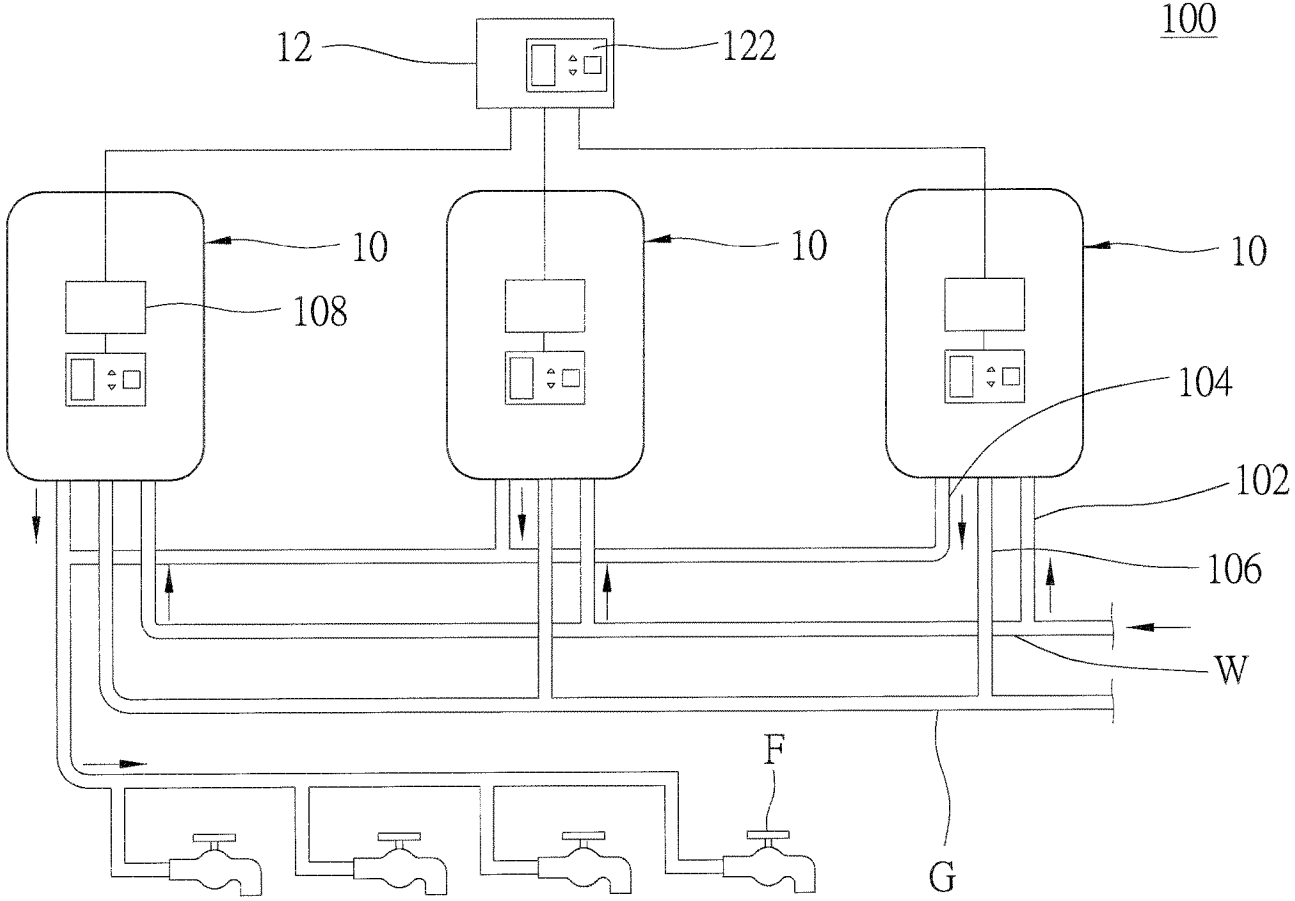
FIG. 1 (PRIOR ART)
FIG. 1 is a sketch diagram of the conventional hot water supply system.
Figure 2:
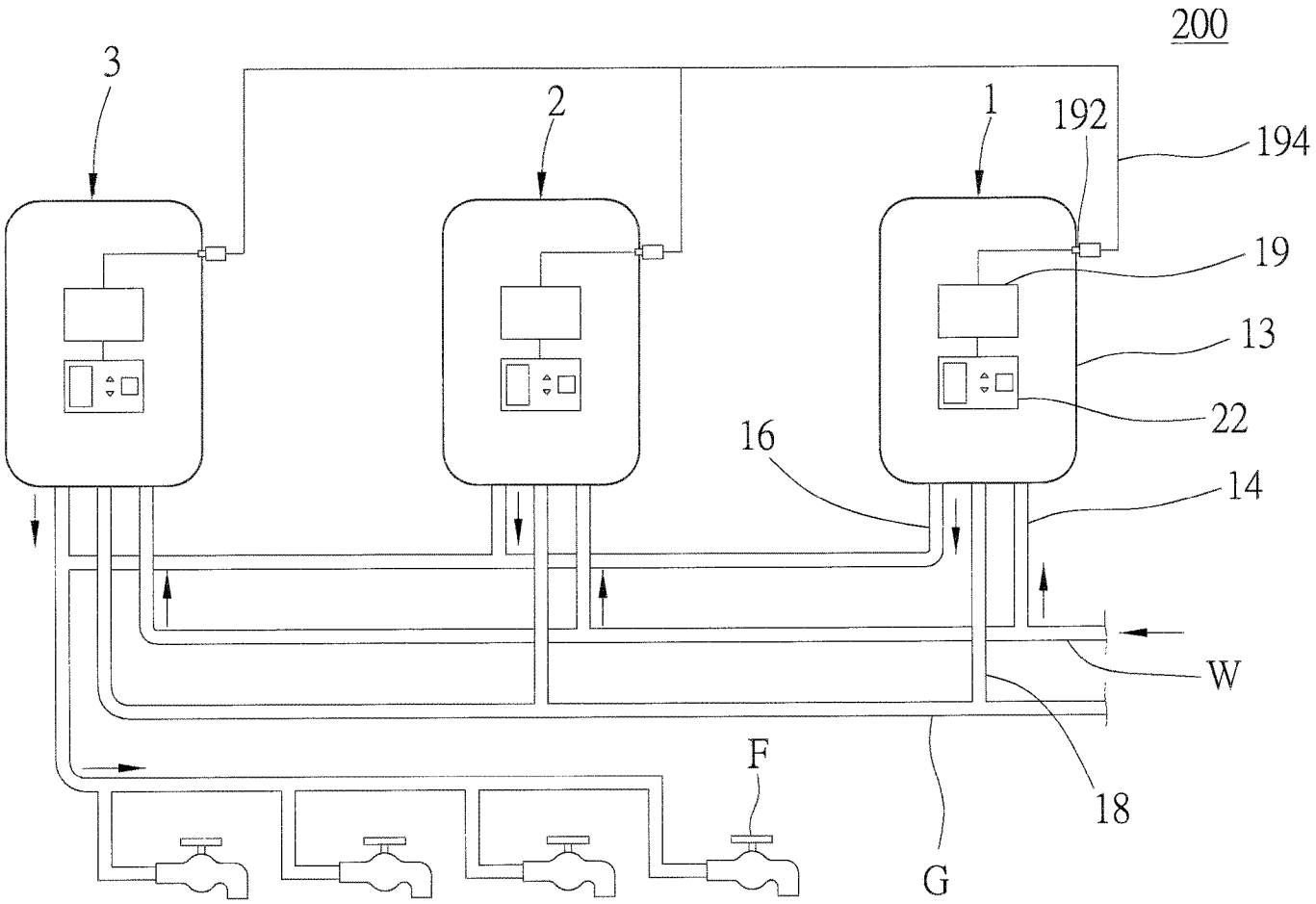
FIG. 2 is a sketch diagram of the hot water supply system of a preferred embodiment of the present invention.

As shown in FIG. 2, a hot water supply system 200 of the preferred embodiment of the present invention is connected to a water pipeline, which includes a water inflow side and a water outflow side. In the preferred embodiment, the water inflow side is a water pipe W, and the water outflow side is a plurality of faucets F. The hot water supply system 200 includes a plurality of water heaters, which are defined as a first water heater 1, a second water heater 2, and a third water heater 3 for convenience of explanation. Each water heater 1, 2, and 3 has a case 13, a conduit, which has an inlet section 14, a heating section 15, and an outlet section 16 in sequence, a gas conduit 18, a control device 19, and a setting unit 22.

Each inlet section 14 is connected with the water pipe W, each outlet section 16 is connected with the faucets F, and the gas conduits 18 are all connected with a gas pipe G. The cases 13 of the water heaters 1, 2, and 3 are respectively provided with a connector 192, which is electrically connected to the corresponding control device 19. Each connector 192 is detachably electrically connected to a signal wire 194, and thereby the control devices 19 of different water heaters 1, 2, and 3 could transmit signals to each other.

Figure 3:
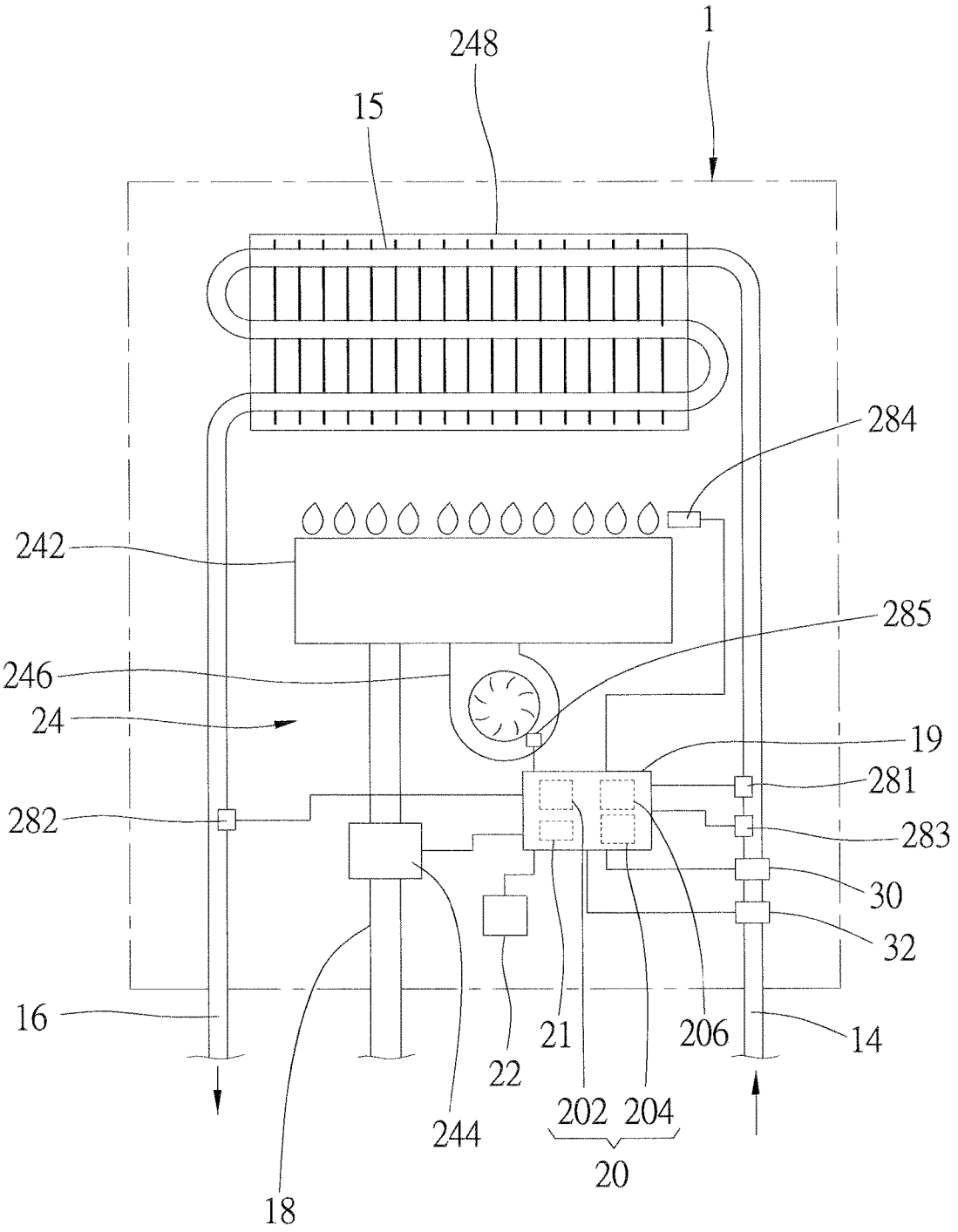
FIG. 3 is a sketch diagram of the water heater of the preferred embodiment of the present invention.

In the preferred embodiment, the water heaters 1, 2, and 3 all have the same structure, and the water heater 1 is taken as an example for explanation in the following description. Please refer to FIG. 3, the first water heater 1 (and the second and the third water heaters 2 and 3 too; please note that such implication will not be specified unless there are good reasons to do so) includes a heating device 24 and a detecting module.

The heating device 24 includes a burner 242, a gas valve 244, a blower 246, and a heat exchanger 248. The burner 242 burns gas to generate flames. The gas valve 244 is provided on the gas conduit 18 which is connected with the burner 242, and the gas valve 244 is controllable to regulate gas flow in the gas conduit 18. The blower 246 supplies air into the burner 242 to mix with gas for burning. The blower 246 is controllable to change its speed for adjusting air flow provided to the burner 242.

The heat exchanger 248 is provided above the burner 242, and the heating section 15 repeatedly passes therethrough. By burning gas, the burner 242 generates thermal energy to heat the heat exchanger 248, and therefore water flows through the heating section 15 gets heated too. As a result, there is hot water flowing out of the outlet section 16. A water regulating valve 30 and a water valve 32 are provided on the water inlet 14, wherein the water regulating valve 30 is controllable to adjust water flow through, and the water valve 32 is controllable to turn on or off water flow in the inlet section 14.

The detecting module includes a plurality of sensors 281-285 which are electrically connected to the control device 19 to detect an operation status of the water heater 1. The detectors 281-285 include two water temperature sensors 281 and 282, a water flow sensor 283, a flame sensor 284, and a rotating speed sensor 285. The water temperature sensors 281 and 282 are provided on the inlet section 14 and the outlet section 16 respectively to detect water temperature therein. The water flow sensor 283 is also provided on the inlet section 14 to detect water flow therein. The flame sensor 284 is provided near the burner 242 to detect if there are flames or not. The rotating speed sensor 285 detects the speed of the blower 246. Of course, other sensors could be provided at different locations in other embodiments if needed.

The control device 19 includes a control unit 20 and a calculating unit 21 which are mutually electrically connected. The control unit 20 of the first water heater 1 is electrically connected to the control units 20 of other water heaters 2 and 3 with the signal wire 194. The control unit 20 has a processor 202 and a memory 204, wherein the memory 204 keeps a master code and a slave code. The setting unit 22, which could be a control panel or a remote control in different embodiments, is connected to the control unit 20, and a user could switch the control unit 20 between a master mode and a slave mode via the setting unit 22. The control unit 20 which is switched to the master mode is defined as a master control unit. The processor 202 executes the master code or the slave code according to the mode selected by the user on the setting unit 22. Only one of the control units 20 of the water heaters 1, 2, and 3 could be the master control unit at a time, and the water heater 1, 2, or 3 which has the master control unit becomes a master of the hot water supply system 200, while other water heaters 1, 2, or 3 being slaves thereof. In the preferred embodiment, the master could also be a slave at the same time.

In the hot water supply system 200 of the present invention, the control unit 20 under the master mode is in charge to coordinate the operation between each water heater 1, 2, and 3, and to keep a turn-on sequence of them (including the master). The setting unit 22 of the master is also a temperature setter, and could be utilized to set a demanded water temperature for water coming out of the hot water supply system 200. In more detail, the setting unit 22 provides the demanded water temperature to the master control unit, and the master control unit 20 transmits the demanded water temperature to each calculating unit 21. In addition, the memory 24 of the master keeps a maximum heating workload and a predetermined upper limit workload of each heating device 24 along with the turn-on sequence, wherein the maximum heating workload indicates thermal energy that each heating device 24 could possibly contribute in a specific period of time, and the predetermined upper limit workload is thermal energy that each heating device 24 is allowed to provide within the specific period of time. In the preferred embodiment, the predetermined upper limit workload is 80% of the maximum heating workload.

Based on the water temperature inside the inlet section 14 and the outlet section 16, the calculating unit 21 of each control device 19 could estimate a heating workload of the heating device 24 (more specifically, the burner 242), wherein the heating workload is thermal energy needed to heat cold water to the demanded water temperature within a specific period of time, and it is proportional to an amount of gas and an amount of air provided to the burner 242. According to the heating workload, the control unit 20 controls the gas valve 244 to regulate the gas flow in the gas conduit 18, and adjusts the speed of the blower 246. In this way, the water temperature of water flowing to the faucets F from the outlet section 16 could reach the demanded water temperature. Meanwhile, the calculating unit 21 transmits the heating workload to the master control unit. Furthermore, the user could assign identifying numbers to each water heater 1, 2, and 3 via each setting unit 22, and the master control unit could identify each water heaters 1, 2, and 3 with the identifying numbers. It should be noted that since the master has the ability to heat water, it could be assigned with one of the identifying number as well.

For convenience of explanation, the first water heater 1 is set to be the master, and the control unit 20 of the first water heater 1, which becomes the master control unit, keeps the turn-on sequence with the first water heater 1 at a first place, the second water heater 2 at a second place, and the third water heater 3 at a third (last) place sequentially. Since the first water heater 1 is the first one to be turned on, the inlet section 14 thereof stays open, while the inlet sections 14 of the second and the third water heaters 2 and 3 are closed as their water valves 32 turning off water flow therein.

Once any faucets F is turned on, the first water heater 1 starts to operate, the calculating unit 21 of the first water heater 1 estimates the heating workload required, and then the control unit 20 controls the heating device 24 to heat water according to the heating workload. The heating workload is monitored by the control unit 20 of the first water heater 1 since it is the master control unit. Because the first water heater 1 is the master and one of the slaves at the same time, the heating workload is transmitted to the master control unit internally.

With more faucets F being turned on, water coming out of the hot water supply system 200 increases. In order to maintain the demanded water temperature, the heating workload gradually rises. Once the control unit 21 of the first water heater 1 finds that the heating workload of the heating device 24 thereof reaches the predetermined upper limit workload, which is 80% of the maximum heating workload of the heating device 24 thereof, the control unit 20 transmits a turn-on signal to the second water heater 2, which is at the second place in the turn-on sequence. After the control unit 20 of the second water heater 2 receiving the turn-on signal, the control unit 20 thereof controls the corresponding water valve 32 to turn on the water flow in the inlet section 14 thereof, and then the second water heater 2 starts heating water too. At the same time, the calculating unit 21 of the second water heater 2 estimates the heating workload required for the heating device 24 thereof. The control unit 20 of the water heater 2 controls its heating device 24 to operate according to the heating workload. The heating workload estimated here is transmitted to the master control unit. Since the inlet sections 14 of the first water heater 1 and the second water heater 2 are both open as their water valves 32 turn on the water flow therein, the first water heater 1 and the second water heater 2 share the responsibility to provide adequate hot water, and therefore the heating workload of the first water heater 1 decreases while the heating workload of the second water heater 2 increases, and they finally approximately equals with each other.

If there are even more faucets F being opened, the water flow provided by the first water heater 1 and the second water heater 2 will further increase. When the master control unit finds that the sum of the heating workload of the first and the second water heater 1 and 2 exceeds 80% of the sum of the maximum heating workload (i.e., the predetermined upper limit workload) of the first and the second water heater 1 and 2, the master control unit 20 transmits the turn-on signal to the third water heater 3, which is at the third place in the turn-on sequence. After the control unit 20 of the third water heater 3 receiving the turn-on signal, the control unit 20 controls the corresponding water valve 32 to turn on the water flow in the water inlet 14 thereof, and then the third water heater 3 also starts heating water. Just as the second water heater 2, the heating workload required is estimated and transmitted to the master control unit, and the heating device 24 of the third water heater 3 is controlled to heat water according to the heating workload.

On the contrary, when the water flow of all water heaters 1, 2, and 3 decreases, the master control unit may find that the sum of the heating workload of each operating heating device 24 is less than the sum of the predetermined upper limit workload of the heating devices 24 of the first and the second water heaters 1 and 2. In such cases, the master control unit transmits a turn-off signal to the third water heater 3, and the water valve 32 thereof turns off the water flow in the corresponding inlet section 14. After receiving the turn-off signal, the third water heater 3 stops operating, and the first and the second water heaters 1 and 2 are responsible to provide hot water on their own again. Furthermore, when the water flow further decreases and the sum of the heating workload of the heating devices 24 of the first and the second water heaters 1 and 2 is less than the predetermined upper limit workload of the heating device 24 of the first water heater 1, the master control unit transmits the turn-off signal to the second water heater 2, the water valve 32 thereof turns off the water flow in the corresponding inlet section 14 after receiving the turn-off signal, and the second water heater 2 stops operating as a result.

In this way, the water heaters 1, 2, and 3 could be coordinated to ensure that the water temperature of water coming out the faucets F reaches the demanded water temperature as set by the user.

It is worth mentioning that since the predetermined upper limit workload is 80% of the maximum heating workload, if the water flow suddenly increases, there will be still 20% to be utilized, which is enough and to spare. Therefore, the water temperature wouldn't plummet even if the next-to-be-turned-on water heater is not ready to operate yet.

Since the first water heater 1 is at the first place in the turn-on sequence, its heating device 24 operates the most frequently, which leads to shorter life than other water heaters 2 and 3. In order to prevent this problem, the control unit 20 of each water heater 1, 2, or 3 further has a counter 206. The counter 206 of the master control unit accumulates heating time of each water heater 1, 2, and 3. Once the accumulated heating time of the first water heater 1 reaches a predetermined threshold, the master control unit would rearrange the turn-on sequence. In the preferred embodiment, the master control unit moves the first water heater 1 to the last place in the turn-on sequence, and then the second and the third water heaters 2 and 3 are moved one place forward. Once the accumulated heating time of the second water heater 2 reaches the predetermined threshold, it would be the turn of the third water heater 3 to be moved to the first place of the turn-on sequence, and so on. In practice, the counter 206 could accumulate operating frequencies of each heating device 24 instead, and the predetermined threshold is based on frequencies in such cases.

If the control unit 20 of each water heaters 1, 2, and 3 finds something going wrong (for example, the water temperature is the inlet section 14 or the outlet section 16 is too high or too low, the speed of the blower 246 is abnormal, or the flames die out, etc.), it transmits an abnormal signal to the master control unit, and then the master control unit transmits the turn-off signal to the abnormal water heater 1, 2, or 3 to make its water valve 32 to turn off the water flow in the inlet section 14 thereof. Therefore, the abnormal water heater 1, 2, or 3 stops operating after receiving the turn-off signal. The next water heater 1, 2, or 3 which is queued at the next place in the turn-on sequence will be turned on to replace the abnormal one if it is idling. Moreover, the abnormal water heater 1, 2, or 3 would be moved out of the turn-on sequence, and those queued behind it are moved one place forward.

If the water flow continuously increases when all the water heaters 1, 2, and 3 are operating, the sum of the heating workload would eventually exceeds the sum of the maximum workload of each heating device 24, and the demanded water temperature may be still unreached even though. In such cases, the master control unit transmits a water flow regulating signal to each control unit 20. After receiving the water flow regulating signal, each control unit 20 controls the corresponding water regulating valve 30 to reduce the water flow in each inlet section 14. Whereby, the water temperature could be maintained as the demanded water temperature.

It is worth mentioning that if the master (say, the first water heater 1) malfunctions and its control unit 20 is not able to work normally, the user could disconnect the master control unit with other water heaters 2 and 3, and then assign one of them to be a new master. As a result, the hot water supply system 200 is operational again even with a malfunctioning water heater (which is the water heater 1 in this example). Once the first water heater 1 gets replaced or repaired, the control unit 20 of the new first water heater 1 could be connected to the control units 20 of other water heaters 2 and 3, and the identifying numbers and the turn-on sequence could be rearranged to accommodate the new first water heater 1. Whereby, the installation is convenient, and the cost of manufacturing and maintenance is lowered effectively.

It must be pointed out that the embodiments described above are only some preferred embodiments of the present invention. All equivalent structures which employ the concepts disclosed in this specification and the appended claims should fall within the scope of the present invention.

What is claimed is:

1. A hot water supply system being connected to a water pipeline, which includes a water inflow side and a water outlet side, comprising:

a plurality of water heaters, each includes a conduit, a heating device, a detecting module, a calculating unit, and a control unit;

wherein the conduit includes an inlet section, a heating section, and an outlet section in sequence; the inlet section and the outlet section are connected with the water inflow side and the water outflow side of the water pipeline respectively, and the heating section is in association with the heating device;

wherein the detecting module detects an operation status of the water heater, and the operation status includes a water temperature inside the inlet section, a water temperature inside the outlet section, and a water flow inside the inlet section;

wherein the calculating unit is electrically connected to the detecting module, and the calculating unit estimates a heating workload of the heating device according to the operation status, and the heating workload is thermal energy needed to heat cold water to a demanded water temperature within a specific period of time;

wherein the heating device is controllable to heat up the heating section, and the heating device has a predetermined upper limit workload, which is thermal energy the heating device is allowed to provide within the specific period of time;

wherein the control unit controls the heating device to heat water, and is electrically connected to the control units of other water heaters;

when the heating workload of the heating device of any water heaters exceeds the predetermined upper limit workload, the control unit of the water heater contacts the control unit of another water heater to control the heating device of the another water heater to heat water, which makes water temperature of water provided to the water outflow side of the water pipeline reach the demanded water temperature;

wherein the control unit of each water heater is able to be operated under a master mode, and only one of the water heaters has its control unit being operated under the master mode at a time, and this control unit is defined as a master control unit; when the heating workload of the heating device of any water heaters exceeds the predetermined upper limit workload, the master control unit controls the heating device of one of other water heaters to heat water;

wherein each water heater further includes a water regulating valve provided on the inlet section, which is controllable to regulate the water flow inside the inlet section; when all water heaters are operating, and the sum of the heating workload of each heating device exceeds the sum of a maximum heating workload of each heating device, which is thermal energy that each heating device could possibly contribute in the specific period of time, the master control unit controls the water regulating valve of each water heater to reduce the water flow inside the inlet section.

2. The hot water supply system of claim 1, wherein the master control unit is connected to a temperature setter, which is provided for setting the demanded water temperature, and the master control unit transmits the demanded water temperature to the calculating unit of each water heater; the master control unit keeps a turn-on sequence of the water heaters and the predetermined upper limit workload of each heating device; the calculating unit of each operating water heater transmits its heating workload to the master control unit; when a sum of the heating workload of each operating heating device exceeds a sum of the determined upper limit workload of each operating heating device, the master control unit controls the heating device of another idle water heater to heat water according to the turn-on sequence.

3. The hot water supply system of claim 1, wherein the control unit of each water heater is electrically connected to each detecting module, and transmits an abnormal signal to the master control unit once the operation status of the belonged water heater is abnormal; after receiving the abnormal signal, the master control unit stops the heating device of the abnormal water heater from heating water, and selects at least one of other water heaters according to a turn-on sequence to replace the abnormal water heater.

4. The hot water supply system of claim 3, wherein the master control unit further removes the abnormal water heater out of the turn-on sequence after receiving the abnormal signal, and moves those water heaters queued behind the abnormal water heater in the turn-on sequence one place forward.

5. The hot water supply system of claim 1, wherein each water heater further includes a water valve provided on the inlet section, which is controllable to turn on or off water flow in the inlet section; the master control unit controls the water valve of the water heater which is being-turned-on to turn on the water flow in the inlet section.

6. The hot water supply system of claim 5, wherein the inlet section of the water heater at the first place in the turn-on sequence stays open.

7. The hot water supply system of claim 1, wherein the control unit of each water heater further includes a processor and a memory; the memory keeps a master code, which is executed by the processor if the control unit is under the master mode; each water heater further includes a setting unit, and the setting unit is provided to set the control unit be operated under the master mode.

8. The hot water supply system of claim 1, wherein the predetermined upper limit workload of each heating device is less than a maximum heating workload, which is thermal energy that each heating device could possibly contribute in the specific period of time.

9. The hot water supply system of claim 1, wherein each water heater further includes a gas conduit, and the gas conduits of the water heaters are connected with each other; the heating device further includes a burner and a heat exchanger, wherein the burner is connected with the gas conduit, and the heating section passes through the heat exchanger; the heating workload is proportional to amount of gas provided to the burner.

10. The hot water supply system of claim 1, wherein each water heater has a case and a signal wire; a connector is provided on the case, and is electrically connected to the control unit; the signal wire is detachably electrically connected to the connector of each water heater.

11. The hot water supply system of claim 1, wherein one of the water heaters is at a first place in a turn-on sequence; the master control unit further has a counter, which accumulates heating time or heating counts of the water heater at the first place in the turn-on sequence; once the accumulated heating time or the heating counts reach a predetermined threshold, the master control unit moves the water heater at the first place to other places in the turn-on sequence.

12. The hot water supply system of claim 11, wherein when the accumulated heating time reaches the predetermined threshold, the master control unit moves the water heater at the first place to a last place in the turn-on sequence, and other water heaters are moved one place forward.

* * * * *